US008568076B1

(12) United States Patent
Harris et al.

(10) Patent No.: US 8,568,076 B1
(45) Date of Patent: Oct. 29, 2013

(54) SEA SURFACE VESSEL RECOVERY AND FUELING SYSTEM

(75) Inventors: Donald B. Harris, Arlington, VA (US); Robert J. Galway, Virginia Beach, VA (US); Brandon Z. Lukert, Virginia Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/529,049

(22) Filed: Jun. 21, 2012

Related U.S. Application Data

(60) Provisional application No. 61/568,206, filed on Dec. 8, 2011.

(51) Int. Cl.
*B65G 27/18* (2006.01)

(52) U.S. Cl.
USPC ..... 414/137.9; 114/242; 114/248; 114/382

(58) Field of Classification Search
USPC ..... 141/138.4, 137.9, 387; 114/248, 249, 114/382, 242, 253
See application file for complete search history.

(56) References Cited

U.S. PATENT DOCUMENTS 2,345,816 A 4/1944 Hays
2,956,532 A 10/1960 James
2,963,179 A 12/1960 Woods et al.
3,364,895 A * 1/1968 De Jong et al. ..... 114/253
3,735,722 A 5/1973 Hooper et al.
3,943,875 A 3/1976 Sanders
4,286,537 A 9/1981 Hvide
4,356,784 A 11/1982 Waters et al.
6,336,419 B1 1/2002 Breivik
6,883,453 B1 4/2005 Mulhern
7,025,014 B1 4/2006 Forgach et al.
7,156,036 B2 1/2007 Seiple
7,506,606 B2 3/2009 Murphy et al.
7,699,015 B1 4/2010 Said
8,020,505 B1 9/2011 Galway
8,225,735 B1 * 7/2012 Galway ..... 114/242

OTHER PUBLICATIONS

Galway, Robert, "Autonomous Refueling of Unmanned Vehicles Sea", Non-Patent Literature; May 19, 2008.

* cited by examiner

*Primary Examiner* — Edwin Swinehart
(74) *Attorney, Agent, or Firm* — Dave A. Ghatt

(57) ABSTRACT

An apparatus for securing and fueling a surface water vessel at a floating receptacle that is towed by a parent ship. The surface water vessel may be a manned or an unmanned surface vehicle, for example. According to the invention, the surface water vessel includes a retractable probe for securing the water vessel to the floating receptacle and also for receiving fuel from the parent ship via the floating receptacle. The floating receptacle has first and second arms pivotally attached to a mounting block, forming a substantially V-shape having an adjustable apex angle.

15 Claims, 10 Drawing Sheets

View x-x

SEA SURFACE VESSEL RECOVERY AND FUELING SYSTEM

CROSS-REFERENCE TO RELATED APPLICATIONS

This application claims the benefit of U.S. Provisional Application 61/568,206, filed Dec. 8, 2011, which is incorporated herein by reference.

This application is related to U.S. Non Provisional patent application Ser. No. 12/537,376, filed Aug. 7, 2009, which is a continuation in part of U.S. Non Provisional patent application Ser. No. 12/079,063, now U.S. Pat. No. 8,020,505, each of which is hereby incorporated by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a method and apparatus for fueling a surface water vessel, and in particular, an arrangement for the contemporaneous latching and fueling of a surface water vessel at a location that is remote from a parent ship.

BACKGROUND

The recovery of smaller surface water vessels, such as manned or unmanned surface water vessels (USVs), by larger parent ships is an emerging technology. Once recovered by the parent ship, servicing operations such as fueling may be performed. Typically, the recovery of a smaller vessel is accomplished by driving the smaller vessel alongside a parent ship and lifting by davit into the ship. Alternatively, the smaller water vessel may be driven up a ramp into the stern of the larger ship.

Traditional methods of capturing smaller surface water vessels can cause damage to the hull of the smaller vessel. For example, some USVs weigh about 20,000 lbs and are made from materials such as aluminum. A capturing method that for example, requires the USV to be driven into a parent ship or be lifted and dropped onto the parent ship can cause damage to the aluminum hull, resulting in expensive repairs. The prior art does not teach an apparatus that automatically guides, latches, and simultaneously fuels a smaller surface water vessel at a floating receptacle remote from the parent ship.

SUMMARY

In one aspect, the invention is a fueling system for securing and fueling a water vessel at a floating receptacle. The fueling system includes a parent ship for supplying fuel and a floating receptacle remote from the parent ship, with the floating receptacle having a substantially V-shape with a substantially V-shaped aperture. In this aspect, the floating receptacle has a first arm, a second arm, and a mounting member, wherein the first and second arm are adjustably attached to the mounting member so that the mounting member, the first arm, and the second arm form the substantially V-shape and substantially V-shaped aperture. The mounting member is at the apex of the substantially V-shape, and the adjustably attached first and second arms allows for an adjustable apex angle $\alpha$. In this aspect, the mounting member further includes a receiver. According to the invention, the fueling system also includes a fuel conduit for transporting fuel from the parent ship to the floating receptacle, and a water vessel. The water vessel has a probe for positioning within the receiver of the floating receptacle to contemporaneously latch the water vessel to the receiver and to receive fuel via the fuel conduit at the floating receptacle. In this aspect, the fueling system also has a towing bridle having a plurality of tow lines, the tow bridle attached to and extending between the parent ship and the floating receptacle maintaining a towing tension on the first and second arms of the floating receptacle so that the adjustable apex angle $\alpha$ is at a maximum angle. The fueling system also includes an inter arm line connected to each of the first and second arms for restricting the adjustable apex angle $\alpha$ at the maximum angle and for reducing the angle $\alpha$ to an angle commensurate with the shape of the water vessel, as the water vessel enters into the substantially V-shaped aperture thereby automatically guiding the water vessel towards the receiver.

BRIEF DESCRIPTION OF THE DRAWINGS

Other features will be apparent from the description, the drawings, and the claims.

DETAILED DESCRIPTION

Figure 1:
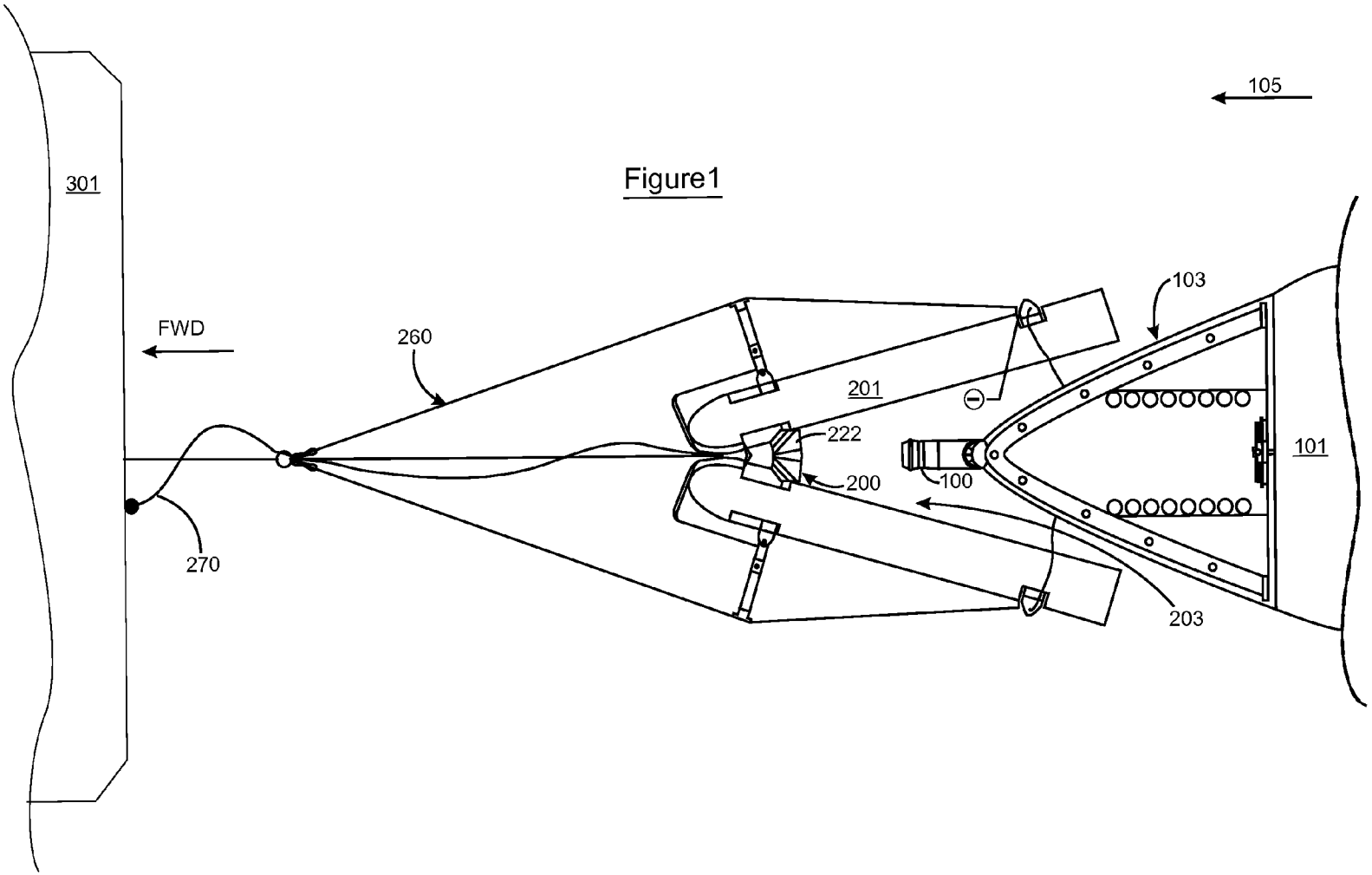
FIG. 1 is an exemplary illustration of a securing and fueling arrangement for a surface water vessel at a floating receptacle according to an embodiment of the invention.

FIG. 1 is an illustration of a securing and fueling arrangement for a surface water vessel 101 at a floating receptacle 201 according to an embodiment of the invention. The arrangement also includes a parent ship 301, which according to an embodiment may be a larger water vessel, such as a sea base which transports smaller vessels such as water vessels 101 and the like. According to another embodiment, the parent ship 301 may be a helicopter or the like. FIG. 1 shows the surface water vessel 101, which may be a manned or an unmanned surface vessel having a forwardly projecting elongated probe 100 at the bow 103 of the water vessel 101. As will be outlined below, the probe 100 may be retractably mounted so that the probe 100 may extend forward from the water vessel 101 in preparation for and during fueling operations. The probe 100 may be retracted inside the body of the water vessel 101 at all other times. The probe 100 is used to secure the water vessel 101 to the floating receptacle 201. As outlined below, if desired, fuel may be supplied, via the probe 100, to a fuel tank within the water vessel 101.

FIG. 1 shows the floating receptacle 201 of the recovery and fueling arrangement having a substantially V-shaped receiving portion 203 for guiding and receiving the bow of water vessels towards a receiver 200, which receives the probe 100 and allows for fueling. As outlined below with respect to FIG. 2, the V-shaped portion is adjustable to facilitate optimized guiding of the water vessel 101 and probe 100 towards the receiver 200. FIG. 1 also shows the receiver 200 having a funnel 222 that also assist with guiding the probe 100 into the receiver. FIG. 1 also shows the floating receptacle 201 connected to the parent ship 301 by a towing bridle 260.

Figure 3A:
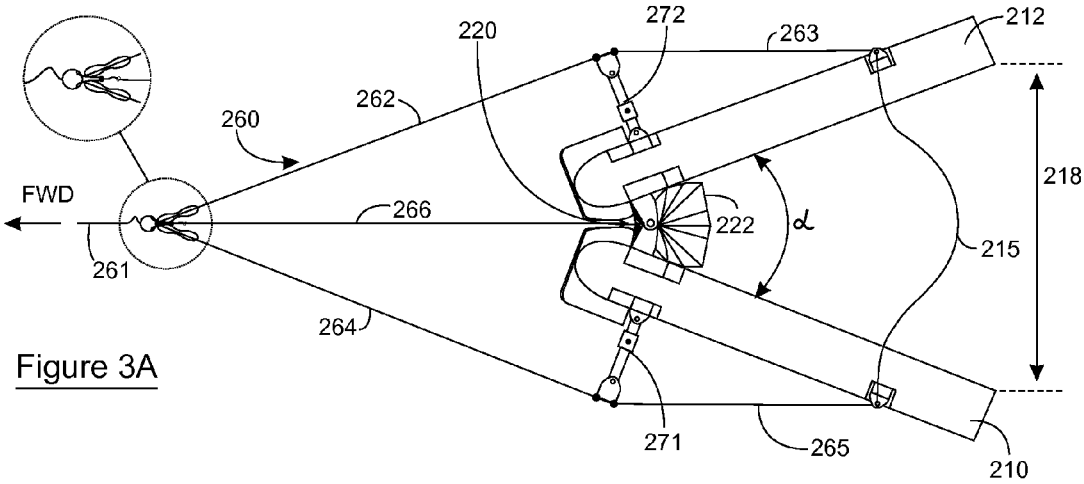
FIG. 3A is an exemplary illustration of a floating receptacle for receiving and fueling a water vessel, according to an embodiment of the invention.
Figure 3B:
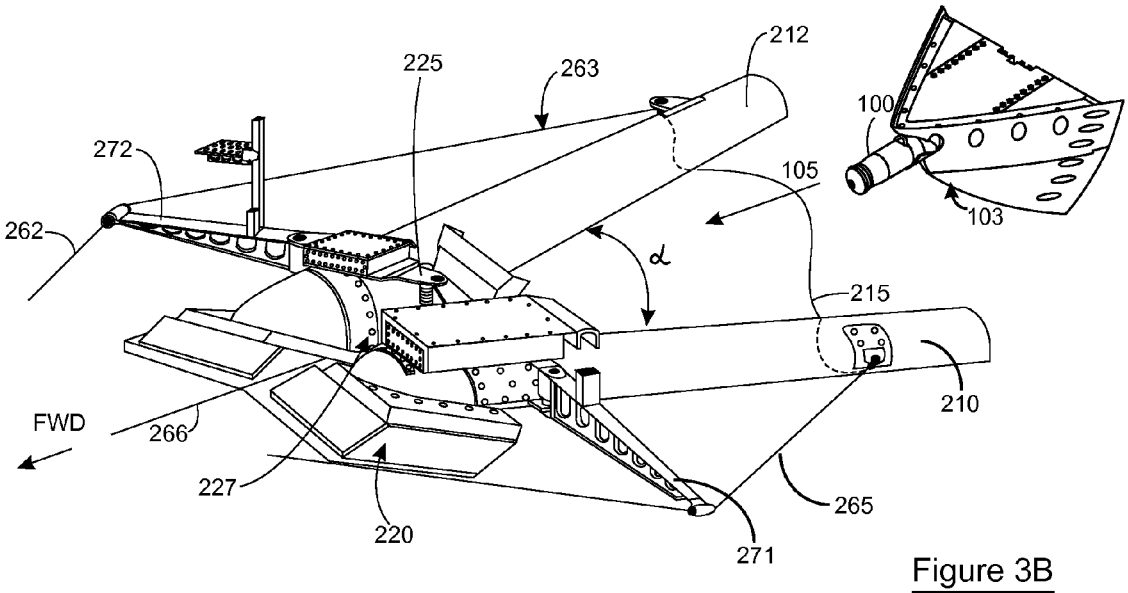
FIG. 3B is an exemplary perspective view of a floating receptacle for receiving and fueling a water vessel, according to an embodiment of the invention.

FIG. 1 also shows a fuel conduit/line 270 such as a hose, running from the parent ship 301 to the receiver 200 of the floating receptacle 201. As outlined below, the conduit 270 delivers fuel from the parent ship 301 to the floating receptacle 201, where vessels such as water vessel 101 are supplied with the fuel. According to the invention, the water vessel 101 may be supplied with fuel only after the probe 100 is fully inserted and secured in the receiver 200 of the floating receptacle 201. FIG. 1 shows arrow 105 indicating the direction in which the water vessel 101 moves with respect to the floating receptacle 201, in order to be secured therewithin. It should be noted that FIG. 1 shows an arrow FWD, which represents a forward direction of the arrangement. This FWD arrow is also shown in FIGS. 3A, 3B, and 3C, indicating a common forward direction, thereby illustrating the orientation of these figures with respect to each other.

Figure 2B:
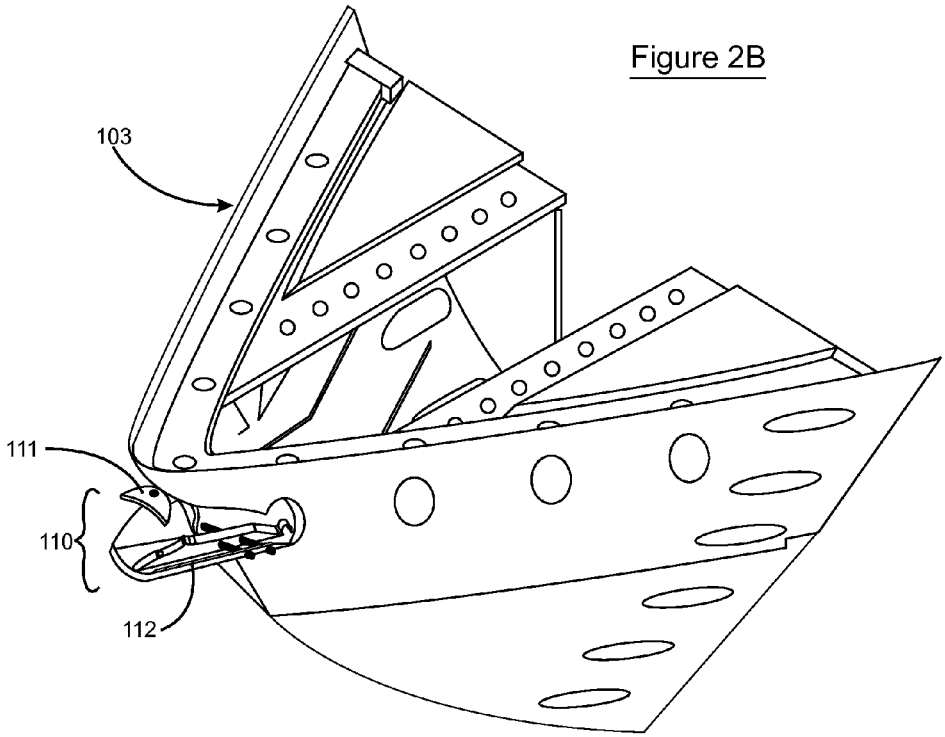
FIG. 2B is an exemplary illustration of a bow section of a water vessel showing a bow hatch assembly, according to an embodiment of the invention.
Figure 2A:
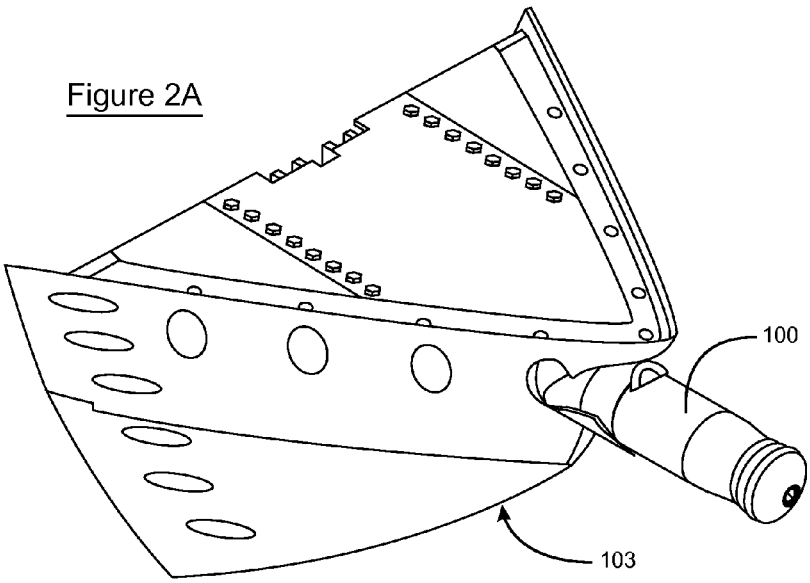
FIG. 2A is an exemplary illustration of a bow section of a water vessel with an elongated probe extending therefrom, according to an embodiment of the invention.
Figure 2C:
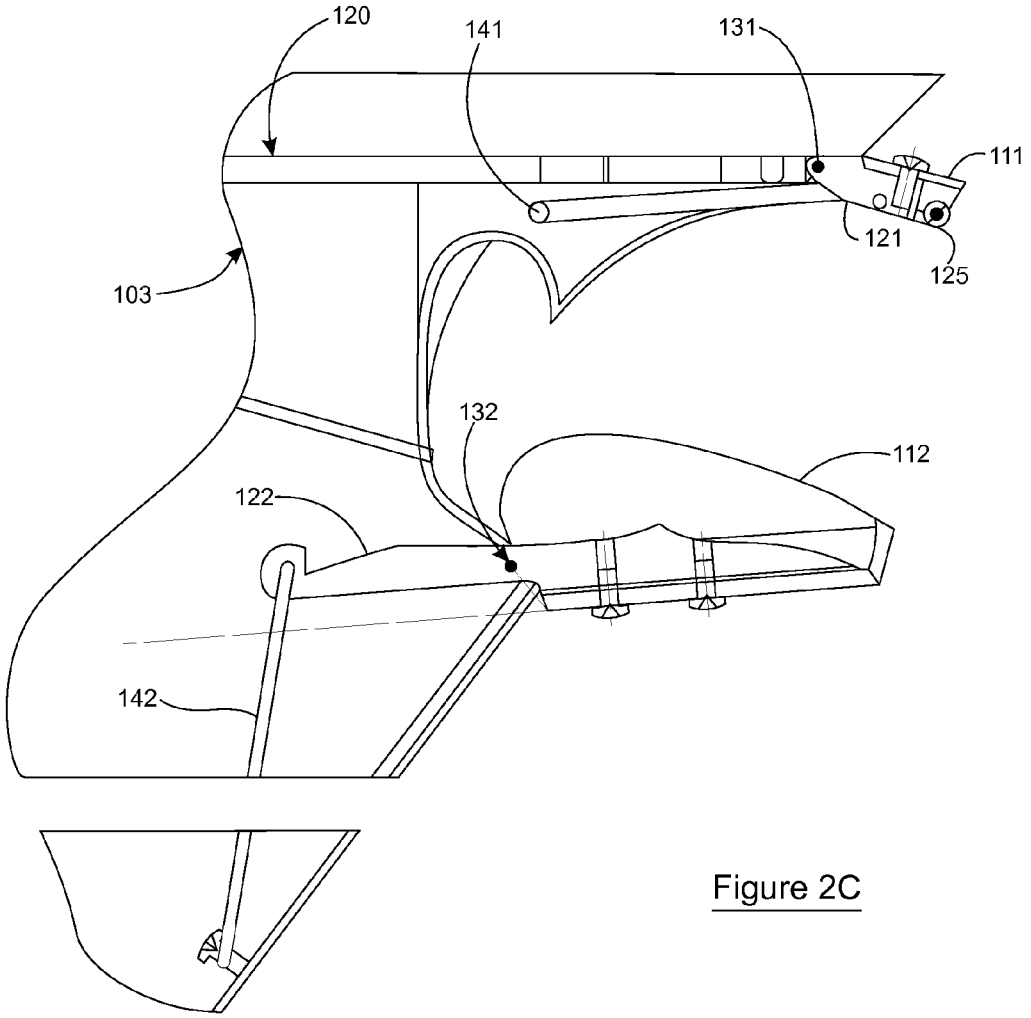
FIG. 2C is an exemplary sectional illustration of a bow section of a water vessel showing a bow hatch assembly, according to an embodiment of the invention.

FIG. 2A is an exemplary illustration of a bow section 103 of the water vessel 101. According to an embodiment of the invention, the bow section 103 may be removably attached to the hull of the water vessel 101 by means of bolts or the like. FIG. 2A shows the elongated probe 100 extending from the vessel hull. As outlined below, the probe 100, which is retractable, is housed within a hatch assembly, from which the probe 100 extends when deployed for fueling operations. In the illustration of FIG. 2A, the probe is shown in the deployed position. FIG. 2B is an exemplary illustration of a bow section of a water vessel showing a bow hatch assembly 110, according to an embodiment of the invention. FIG. 2C is an exemplary sectional illustration of a bow section of a water vessel showing a bow hatch assembly, according to an embodiment of the invention. The hatch assembly 110 is provided to maintain the hydrodynamic form of the water vessel 101 during normal operations of the vessel 101, by avoiding drag and other inefficiencies that may be caused by a permanently protruding probe or an opening in the bow. As shown, the hatch assembly 110 includes an upper hatch cover 111 and a lower hatch cover 112, both positioned at the front end of the bow section 103. When the probe 100 is deployed for fueling operations, the upper and lower hatch covers 111 and 112 are opened to allow the probe 100 access therethrough. When the probe 100 is retracted within the hull of the water vessel 101, the upper and lower hatch doors are closed, thereby optimizing the hydrodynamics of the water vessel 101.

As shown in FIG. 2C, the upper and lower hatch covers 111 and 112 are fitted to upper and lower mounting brackets 121 and 122, respectively. As shown in FIG. 2C the upper mounting bracket 121 is pivotally connected to a hull frame portion 120 by means of pivot 131, which enables the opening and closing of the upper hatch cover 111. Also illustrated is the lower mounting bracket 122, which is also pivotally connected to the frame portion 120 by means of a pivot 132, enabling the opening and closing of the lower hatch cover 112.

FIG. 2C also shows a strip of elastic material 141 connected at one end to the upper mount mounting bracket 121 and at the other end to a portion of the vessel frame 120, which biases the upper hatch cover 111 in the closed position. Similarly, a strip of elastic material 142 is connected at one end to the lower hatch mounting bracket 122 and at the other end to a portion of the frame 120, biasing the lower hatch cover in the closed position. The upper and lower mounting brackets 121 and 122 are configured to be pushed into the open position by the front tip of the probe 100, as the probe extends into the deployed position. The brackets 121 and 122 are configured to be held in the open position by the body of the probe 100 as the probe extends and is held in the deployed position. When the brackets 121 and 122 are in the open position, the upper and lower hatch covers 111 and 112 are also held in the open position. As stated above, FIG. 2A shows the probe 100 in the deployed position. Conversely, when there is no contact with the probe 100, the upper and lower mounting brackets 121 and 122 are biased in the closed position, along with the attached upper and lower hatch covers 111 and 112. As shown, the upper mounting bracket 121 is fitted with a small roller 125 to reduce the effects of friction when the probe 100 is retracted and reduce the likelihood of binding.

Figure 2D:
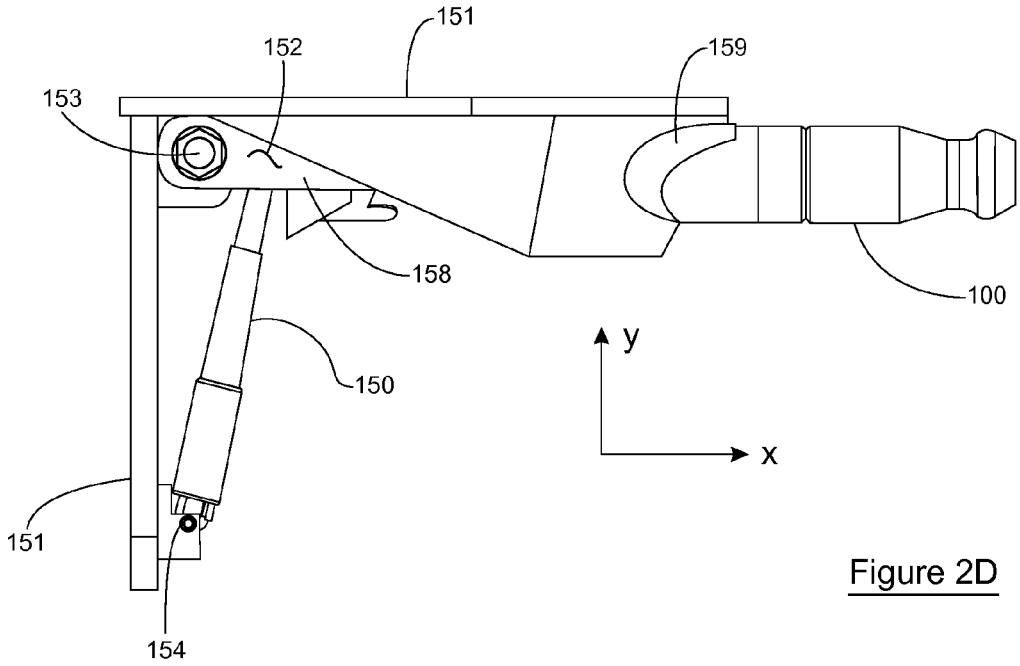
FIG. 2D is an exemplary side view of an actuator assembly at the bow section of a water vessel, according to an embodiment of the invention.
Figure 2E:
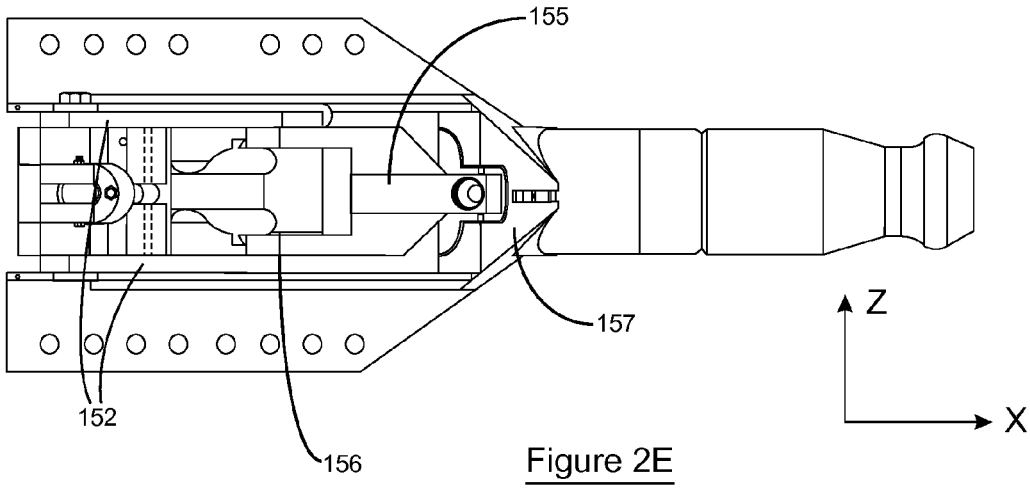
FIG. 2E is an exemplary bottom view of an actuator assembly at the bow section of a water vessel, according to an embodiment of the invention.

FIG. 2D is an exemplary sectional illustration of an actuator assembly at the bow section 103 of a water vessel 101, according to an embodiment of the invention. The actuator assembly may be a "drop-in" assembly that may be removably attached to the bow section 103. FIG. 2E is an exemplary bottom view of an actuator assembly at the bow section 103 of a water vessel 101, according to an embodiment of the invention. As stated above, the bow section 103 may be removably attached to the hull of the water vessel 101. As shown, the actuation assembly includes an interface mount 151 that is fastened to the frame of the water vessel 101 at the bow section 103. The interface mount 151 includes a linear bearing 159 that supports the probe 100 and constrains the positioning of the probe 100 in the Y, and Z directions, as shown in FIGS. 2D and 2E, preventing rotation about axes in the YZ plane. Generally, in operation this means that the probe is constrained from rotating about Y axes normal to a base plane of the water vessel 101 or about Z axes that are athwartship to the water vessel 101.

FIGS. 2D and 2E also show linkage members, aft link 152 and forward link 155. The aft link 152 is pivotally connected via a pivot member 153 to the interface mount 151. The aft link 152 is also connected to the forward link 155 by a pivot member 156. As shown, the aft link 152 and forward link 155 constrain the probe 100 in the X direction. The forward link 155 is connected to the probe via pivot member 157. As shown, a linear actuator 150 is connected to the interface mount 151. As shown, a lower end of the actuator 150 is attached to the interface mount 151, via a pivot member 154. An upper end of the actuator 150 is connected to the aft link 152 by means of another pivot member 158. When the linear actuator 150 is retracted, the aft link 152 is drawn down and aft about the pivot member 153. Simultaneously, the forward link 155 is drawn aft and down by the pivot member 156 connection to the aft link 155. The probe 100 is pulled aft, sliding along a linear bearing 159. In this embodiment, the linear actuator 150 has a range of motion that is fixed by its design.

The geometry and juxtaposition of the linkages 152 and 155 and the corresponding pivot members 153, 156, and 157, and the linear actuator mounting pivots 154 and 152 are such that the linear actuator 150 reaches its maximum length just as the probe 100 is fully deployed. The aft 152 and forward 155 links are positioned such that the corresponding pivot members 153, 156, and 157 are nearly coplanar coincident with the linear actuator 150 reaching its maximum length. In this configuration, the vast majority of fore and aft forces imposed on the probe 100 during its engagement with the different elements of the floating receptacle 201 such as the receiver 200 for example, are transmitted through the linkages and pivot members outlined above, to the interface mount 151, and to the host vessel bow section 103, and finally to the host vessel hull structure without significantly affecting the linear actuator 150.

The arrangement, as illustrated in FIGS. 2A-2E enables a light weight, low power, and inexpensive actuator 150 to be employed and yet the system can still withstand the engagements loads that can potentially be many thousand times more than that required to extend and retract the probe 100. In addition, the links 152, 155 and their complementary pivot members 153, 156, and 157 have configurations such that the linear actuator 150 is either maximally extended when the probe 100 is fully extended and minimally extended when the probe 100 is fully retracted. In this embodiment, the foregoing linkage is such that the extension or retraction of the probe 100 and linear actuator 150 occur simultaneously and as such no limit switches are required to stop the linear actuator 150 when a limit is reached, simplifying the control to that of on/off with reversing polarity to change direction.

FIG. 3A is an exemplary illustration of a floating receptacle 201 for receiving and fueling a water vessel 101, according to an embodiment of the invention. FIG. 3B illustrates a perspective view of the floating receptacle 201. As shown, the floating receptacle 201 has a substantially V-shape, having first and second elongated arms 210 and 212. Each arm 210 and 212 may be a sponson having a known design such as, an air filled chamber, or a solid foam. For example, the first and second elongated arms may be an ultra-high-molecular-weight polyethylene pipe filled with closed cell foam to ensure floatation. In embodiments in which the arms 210 and 212 are solid foam, the foam design helps to absorb the impacts associated with guiding the water vessel 101 into the floating receptacle 201. As shown, the arms 210 and 212 are connected to each other in an angled manner to provide the substantially V-shaped structure, with the arms connected to a mounting member 220, which may be a weldment structure. The funnel 222 is attached to the weldment structure for receiving and guiding the probe 100 for fueling.

The mounting member 220 includes a hinge 225 that pivots about an axis, which in the illustration of FIG. 3A extends perpendicularly out of the page. In operation on calm water, this axis is substantially equal to a vertical axis. The hinge 225 allows movement of the elongated arms 210 and 212, relative to one another, forming an apex region having an apex angle $\alpha$ between the arms 210 and 212. The angle $\alpha$ between the arms can range from zero with both elongated arms parallel to one another to an angle $\alpha$ of about 15 degrees to about 25 degrees. This hinged structure allows the elongated arms 210 and 212 to be folded together to a zero angle $\alpha$ for shipping or storage to minimize the volume required, and when deployed, the arms 210 and 212 may be opened to an angle $\alpha$ of about 15 degrees to about 25 degrees. In an embodiment of the invention as shown in FIGS. 3A and 3B, the angle $\alpha$ between elongated arms 210 and 212 is limited by an intra-arm line 215 that is connected at one end to the port arm 210 and at the other end to the starboard arm 212. In operation, the intra-arm line 215 is attached at bottom portions of the arms 210 and 212, and drags in the sea as the floating receptacle 201 is towed behind the parent ship 301.

In another embodiment of the invention, the value of the angle $\alpha$ between the arms 210 and 212 could be constrained by a mechanical stop incorporated into the mounting member 220. In still another embodiment, the value of the angle $\alpha$ between the arms 210 and 212 could be mechanically controlled by a powered system incorporated into the mounting member 220. Such a system could vary the angle $\alpha$ throughout the usage cycle and optimize same for each phase of acquisition, engagement, fuel transfer, and release.

FIGS. 3A and 3B also show the towing bridle 260, that includes a plurality of tow lines. The towing bridle 260 includes a tow line 261, a forward starboard tow line 262, an aft starboard tow line 263, a forward port tow line 264, an aft port tow line 265 and a center tow line 266. The entire system is towed by tow line 261 that typically leads to parent ship 301. In other embodiments this tow line 261 could be lead to a helicopter, submarine, hovercraft, or other source of towing tension. As shown, the center tow line 266 is connected to the aft end of the tow line 261 and to the forward end to a receiver mechanism 227 on the mounting member 220. The receiver mechanism 227 may be a hook or the like that allows the tow line 266 to be tied thereto. FIGS. 3A and 3B also show outriggers 271 and 272 attached to elongated arms 210 and 212 respectively. As shown, the outrigger 271 is portside and associated with the elongated arm 210, and the outrigger 272 is starboard and associated with the elongated arm 212. FIGS. 3A and 3B show the port and starboard forward tow lines 264 and 262 similarly connected to the aft end of the tow line 261 and to a forward end of port and starboard outriggers 271 and 272. The port 265 and starboard 263 aft tow lines are connected to the aft end of the port 271 and starboard 272 outriggers and to the aft end of elongated arms 210 and 212, respectively.

Figure 3D:
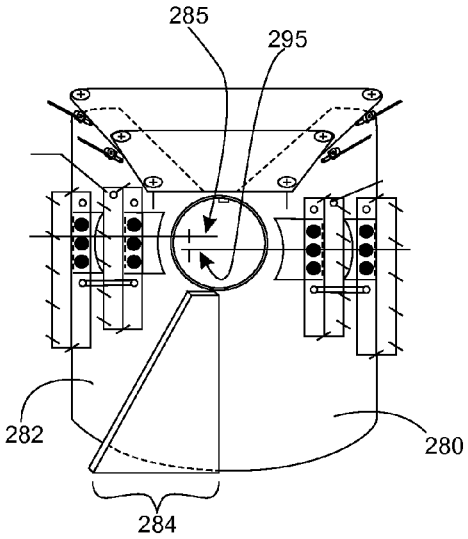
FIGS. 3D and 3E are exemplary illustrations of the funnel of the receptacle, according to an embodiment of the invention.
Figure 3E:
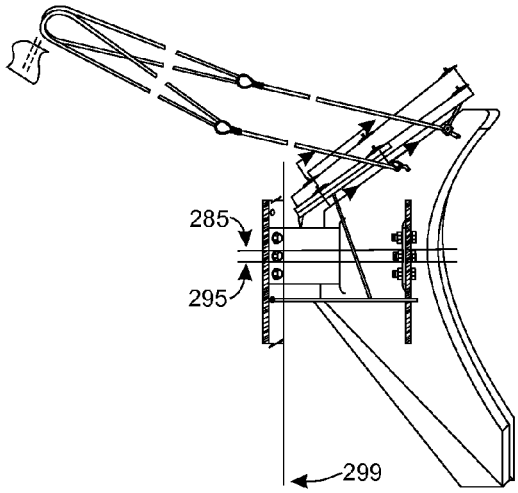
Figure 3C:
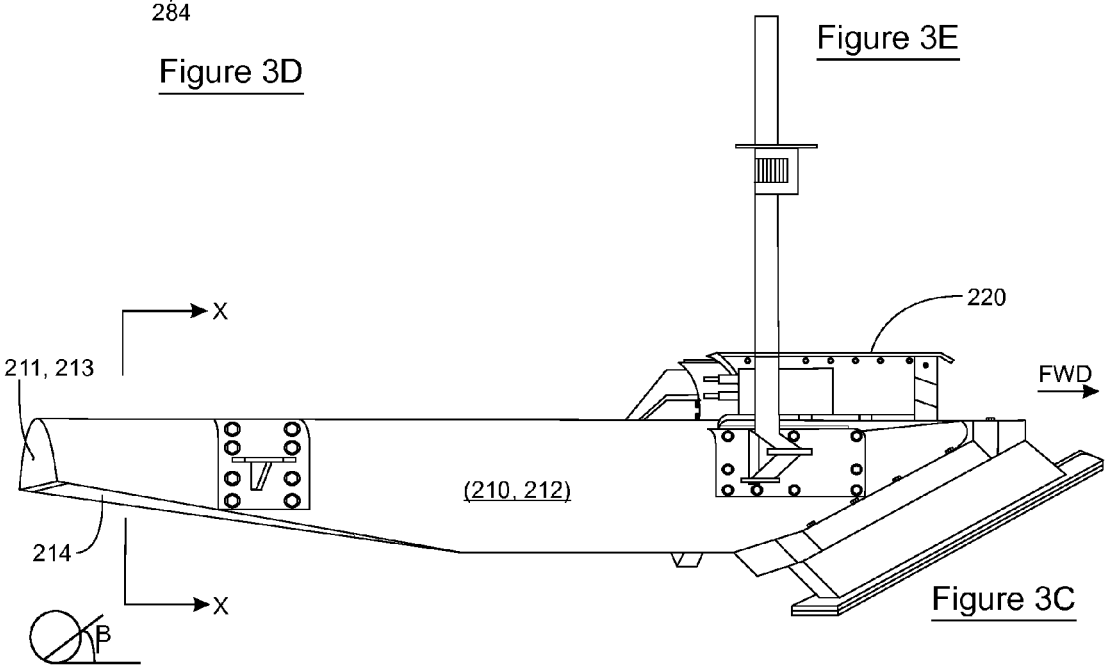
FIG. 3C is an exemplary illustration of a sponson, according to an embodiment of the invention.
Figure 3F:
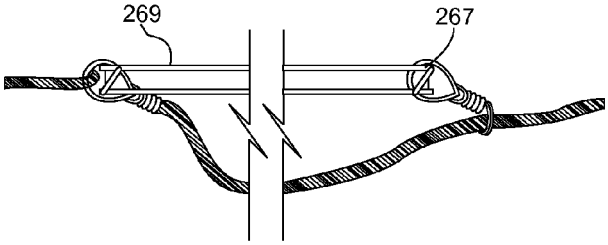
FIG. 3F is an illustration of an elastic arrangement associated with port and starboard tow lines of the tow bridle, according to an embodiment of the invention.

FIG. 3F is an illustration of an elastic arrangement associated with port and starboard tow lines 264 and 262 of the tow bridle 260, according to an embodiment of the invention. The tow bridle has elastic elements 269 that are connected to both of the port and starboard forward lines 264 and 262. On the port side, the elastic element 269 is connected to the extreme aft end of tow line 261 and to a seizing 267 that is located some distance aft of the forward end of 264. According to one embodiment, the elastic element 269 has a relaxed length of about 21 inches. In this embodiment, the elastic element 269 is connected to the port forward tow line 264 at a point about 27 inches from the front. According to this embodiment, when the system is towed, the elastic element 269 will be stretched to a length greater than its 21 inch relaxed length but limited to a maximum of, in this embodiment, 27 inches. This feature is symmetrically installed on both port 264 and starboard 262 forward tow lines. Therefore, the elastic element 269 provides some compliance in the port and starboard forward tow lines 264 and 262.

According to an embodiment of the invention, the tow bridle 260 may be configured such that the center tow line 266 is just slack or only lightly tensioned when towing, and in operation, the majority of towing tension is passed from tow line 261, through the elastic element 269 on both port 264 and starboard 262 forward tow lines and to the aft tow lines 265 and 263 via outriggers 271 and 272. Towing tension will spread the elongated arms 210 and 212, which will rotate symmetrically about hinge 225 to an included angle $\alpha$ that is constrained by the intra-arm line 215. As outlined above, each arm 210 and 212 may be an air-filled chamber, such as a sponson. If a larger included angle $\alpha$ is desired, the operator could lengthen the intra-arm line 215. The tendency for hydrodynamic drag to close the elongated arms 210 and 212 is more than offset by the moment created by the towing tension in lines 264 and 265 acting through outrigger 271 on the port side and similarly by lines 262 and 263 acting through outrigger 272 on the starboard side. The included angle $\alpha$ must be set, via intra-arm line 215, to a value that presents an aperture 218 that is wide enough for the surface water vessel 101 to reliably find its way into the aperture 218.

FIG. 3C is an exemplary illustration of a sponson, according to an embodiment of the invention. As outlined above, each arm 210 and 212 may be an air-filled chamber, such as a sponson. The sponson in FIG. 3C is representative of either elongated arm 210 or elongated arm 212. As illustrated, according to this embodiment, each of the elongated arms 210 and 212 is fitted with an angled counter 214. As outlined above, the arms 210 and 212 are intended to be towed at an angle $\alpha$ with respect to each other. The angled counter 214 is incorporated into both elongated arms 210 and 212 at respective free ends (211, 213), with the counter angled a small amount to present a flat surface that will offset the tendency to submerge and to reduce towing drag. The counter angle $\beta$ is shown with respect to X-X section view in FIG. 3C. According to an embodiment the counter 214 angle $\beta$ is about 10 degrees.

During fueling operations, the surface water vessel 101, which may be a manned or unmanned surface vessel, is first secured and latched by the floating receptacle 201. After being properly latched, fuel is fed to the water vessel 101 through the probe 100. As shown in FIG. 1, this process begins when the bow 103 of the surface water vessel 101 is directed into the substantially V-shaped receiving portion 203 while moving generally in the direction 105. However securing and latching can only be accomplished if the probe 100 is properly aligned with the receiver 200. The water vessel is guided towards the receiver 200 by the elongated arms 210 and 212, which have the substantially V-shaped arrangement with the receiver 200 at the apex of the V. Thus the arms 210 and 212 "funnel" the surface water vessel 101 towards the receiver, as outlined below.

As the surface vessel 101 enters the aperture 218, the water vessel 101 encounters the intra-arm line 215 as this occurs. The keel of the surface water vessel 101 will press the intra-arm line 215 deeper into the water. When this occurs, the arms 210 and 212 will be pulled together, reducing the included angle $\alpha$ until the arms 210 and 212 make physical contact with the surface water vessel 101. At this point the surface vessel 101 and elongated arms are in contact with one another and forward motion of the surface vessel 101 in a direction relative to the floating receptacle 201 (substantially in the direction of arrow 105) will force the floating receptacle 201 into the sea and lift the water vessel 101 from the sea. This will gradually increase the magnitude of contact force between water vessel 101 and the arms 210 and 212 of the floating receptacle 201. The increased contact force will tend to dampen relative motion and force the surface vessel 101 and sled into phase in heave, pitch, sway, roll, and yaw. In this way the floating receptacle 201 adjusts to the size and shape of vessels such as surface water vessel 101, which may vary.

The surface water vessel 101 will reduce its propulsive machinery throttle setting after the probe 100 connects to the receiver 200. Once this occurs, the surface water vessel 101 will be towed by the probe 100. The increase in towing tension in combination with the reduction of the included angle $\alpha$ between elongated arms 210 and 212 will stretch the elastic 269 in port 264 and starboard 262 forward tow lines. The elastic 269 will elastically elongate until the center tow line 266 becomes tight.

FIGS. 3D and 3E are exemplary illustrations of the funnel 222 of the receptacle, according to an embodiment of the invention. FIG. 3D is illustrated as if an observer is looking aft from a position in front of the assembly. The funnel 222 is comprised of a port 280 and starboard 282 sections. Each section is fixed to member 220. The mounting member 220 includes a hinge feature, and thus the funnel 222 must accommodate relative motion and yet maintain a continuous surface to guide the probe 100 into the receiver 200 to enable refueling. To accomplish this, the funnel 222 has three conical surfaces. The starboard guide surface 282 is in the form of a 45 degree cone centered about a horizontal axis 285. The port guide surface 280 is in the form of a 45 degree cone centered about a horizontal axis 295 that is displaced below the starboard guide surface axis 285 by a distance that places the bottom edge of the starboard section 282 just above the port section 280. The overlap between the port 280 and starboard 282 funnel guide sections has a 45 degree conical surface about a vertical axis 299 that intersects the port 295 and starboard 285 axes at right angles. The vertical axis 299 is also coincident with the sponson hinge pin 225. The overlapping section 284 forms a smooth and continuous surface that closely matches the underside of the starboard section 282 and maintains this close clearance over a range of angular motion that encompasses the normal operating envelope for the system.

Also, a set of elastically mounted strips form a top connecting section between the port section 280 and the starboard section 282 that act to restrict the relative pitch between the surface water vessel 101 and the floating receptacle 201. The elastic mounting of these strips permit them to initially guide and then be displaced by the rake of the hull of the water vessel 101 as connection is made between the probe 100 and the receiver 200.

Figure 4A:
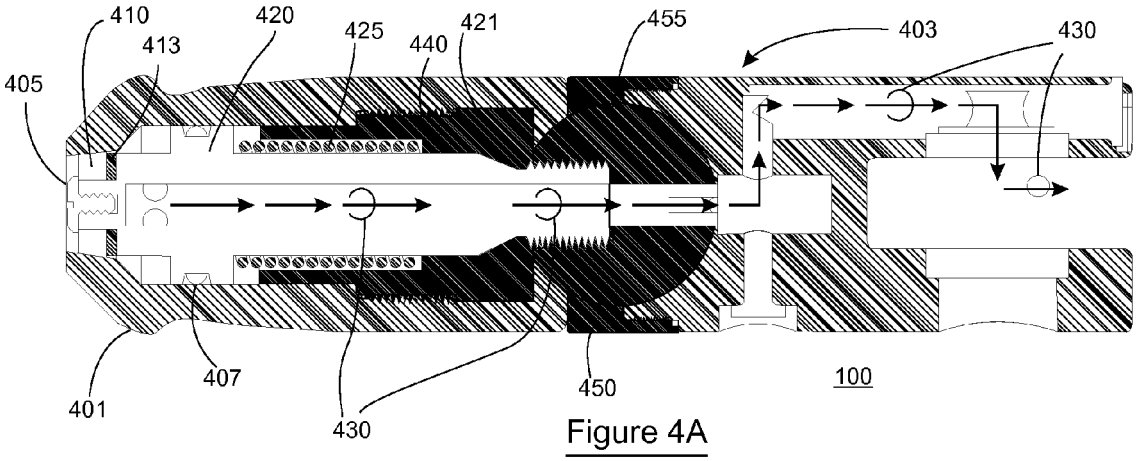
FIG. 4A is an exemplary sectional illustration of a probe, according to an embodiment of the invention.

FIG. 4A is an exemplary sectional illustration of a probe 100 of the surface water vessel 101 showing a valve arrangement, according to an embodiment of the invention. As outlined below, the probe 100 includes a spring closed valve arrangement that is opened by towing tension after the probe 100 is latched to the receiver. As shown in FIG. 4A, the probe 100 includes a front body portion 401 and a back body portion 403, with the spring closed valve arrangement outlined herein, located primarily in the front body portion 401. The valve arrangement includes a spool 420 inside the front body portion 401, and a compression spring 425 within the front body portion and around the spool 420, the compression spring communicating between the spool 420 and the front body portion 401. As outlined below, the front body portion 401 is slidable with respect to the spool 420. FIG. 4A also shows an insert 440 for limiting the sliding movement of the front body portion 401.

FIG. 4A also shows the valve arrangement of the probe 100 having a front cap 405 and a valve seal 410. When the front body portion 401 is in its aft most position, the valve seal 410 will make contact with and create a fluid tight seal on a mating interior surface of the front body 401. FIG. 4A also shows a ball retainer 450 and a ball 455 located at a connection portion between the front and back body portions 401 and 403, with both front and back body portions 401 and 403 having semi-spherical cavities for accommodating the ball 455. The ball 455 is spherically shaped and fitted with a fuel passage within, the ball 455 connecting the front and back body portions 401 and 403. As shown, a probe fuel port 430 extends from within the front body portion 401 through the passage in the ball 455 to the back body portion 403. According to an embodiment of the invention, the spool 420 is fastened to the ball 455. According to an embodiment, when assembled, the ball 455, the spool 420, the insert 440, and front body part 401 of the probe 100 are free to rotate up to 45 degrees in any direction.

During fueling operations, as shown in FIG. 1, the bow 103 of the water vessel 101 is directed between the elongated arms 210 and 212 of the floating receptacle 201, until the probe 100 is inserted into the receiver 200. Once the front body portion 401 of the probe 100 is engaged by the receiver 200, in accordance with fueling operations, the surface water vessel 101 may throttle down in order to be towed by the parent ship 301. In embodiments in which the water vessel 201 is a USV, the throttling down may be done automatically or remotely, and in embodiments in which the water vessel is manned, an operator may control the throttling. Because of the throttling down, the front body portion 401 is pulled forward. When the tension applied to the front body portion 401 of the probe 100 exceeds a pre load on the compression spring 425, the front body portion 401 will slide forward on the spool 420. This opens an annular space between the valve seal 410 and the interior mating surface at the front body portion 401 at the tip of the probe tip 100. The opening of this annular space opens the probe fuel port 430 that extends from within the front body portion 401 through the ball 455 to the back body portion 403. This allows fuel to be pumped through the probe 100. The fuel port 430 remains open as long as sufficient towing tension exists. The forward travel of the front body portion 401 is constrained by the insert 440. According to this embodiment, the load path for towing tension starts at an external groove at the front body portion 401, then to the insert 440, then to the spool 420, then to the ball 455, then to the ball retainer 450 then to the back body portion 403 of the probe 100. Because of the spring arrangement outlined above, the valve automatically closes when the tension is lost.

The arrangement of the elements of the probe 100, as outlined above, also provides the probe with an overall flexibility. As outlined above, and as shown in FIG. 4A showing the probe 100 in a deployed orientation, the front body portion 401 of the probe 100 rides on the spool 420 at the front where the spool 420 contacts the interior of the front body portion 401 near an O-ring seal 407, and at the back where the insert 440 contacts the spool 420. The front body portion 401 can move axially on the spool 420 over a short range that is constrained in the forward direction by the insert 440 contacting the spool 420 just behind the o ring seal 407. In the aft direction, the front body portion 401 is constrained by contact with the ball retainer 450. The spring 425 has a relaxed length that is greater than the distance from the insert 440 to the O-ring surface of the spool 420. According to one embodiment, this pre load is about 200 pounds.

The pre-load of the spring 425 serves to keep the above described tension actuated valve in the closed position. The pre-load also serves to hold the aft surface of the front body portion 401 axis against the flat front surface of the ball retainer 450, which is normal to the back body portion 403 and so the front body portion 401 is held parallel to and axially coincident with the back body portion 403 when deployed. The front body portion 401 will remain in this position unless a force is applied to the front body portion 401 with a component normal to the longitudinal axis of the probe 100 that will cause the probe tip 401 to rotate about the center of the ball 455 by sliding forward on the spool 420, and thereby additionally compressing the spring 425. In one embodiment of the invention, the front body portion 401 will snap back into the configuration where it is parallel to and axially coincident with the back body portion 403 when the above described force normal to the longitudinal axis of the probe 100 is applied to the front body portion 401 is removed. The spring constant and preload force, diameter of the front body portion 401, and juxtaposition of the pivot axes of the ball 455, all combine to characterize the flexibility of the front body portion 401 during a connection with the receiver 200.

The spool 420 also includes a weak link feature that minimizes the spilling of fuel if there is a failure in the apparatus. The spool 420 has a prismatic cross section between the O-ring seal 407 and ball 455 except for a tapered section 421 in the aft. The taper serves two purposes. First, the taper provides clearance to enable a full 45 degrees of rotation of the ball 455 when assembled, as shown. Second, the taper creates a frangible link where the spool 420 can fail when and if the system is forced to bend more than the 45 degrees provided for in this embodiment. This failure is an integral part of this embodiment and is meant to serve as a mechanical fuse that will prevent further failures in the surface water vessel 101 in the event of a collision or other accident. Another feature of above described weak link is that if the spool 420 fails due to a collision or other event, the ball 455 will be left in a position rotated 45 degrees from the axis of the back body portion 403 of the probe 100, and as such, the probe fuel port 430 will be blocked, minimizing the amount of fuel that is spilled and the contamination of fuel by sea water.

Figure 5A:
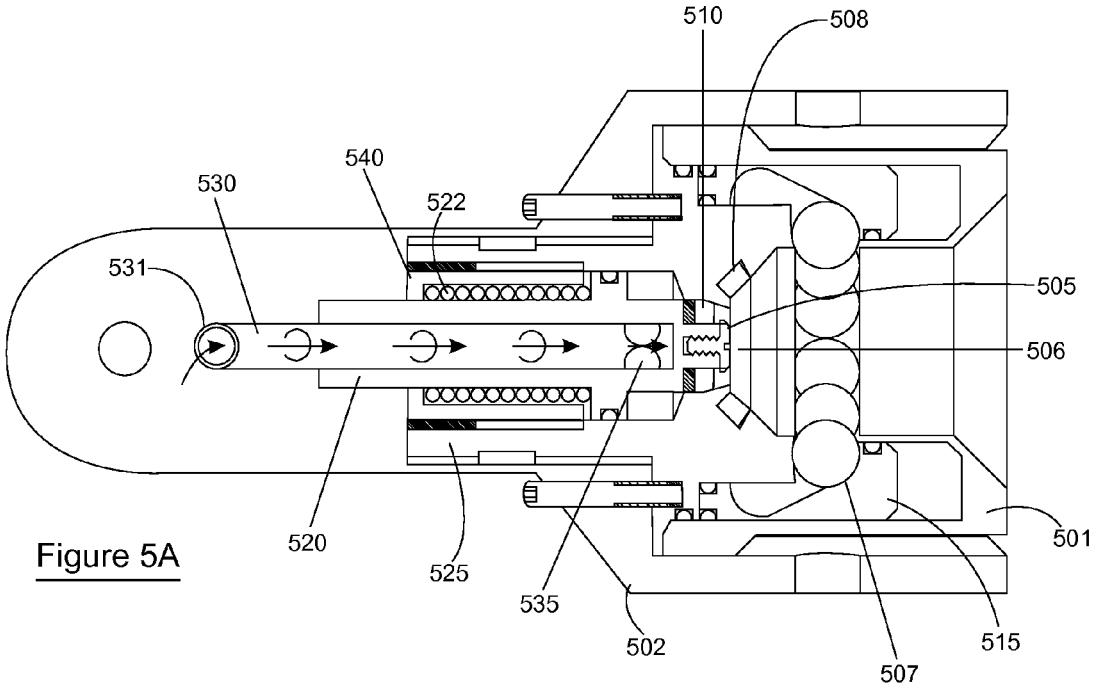
FIG. 5A is an exemplary sectional illustration of a receiver, according to an embodiment of the invention.

FIG. 5A is an exemplary sectional illustration of a receiver 200 of the floating receptacle 201, according to an embodiment of the invention. The arrangement of the elements of the receiver 200 is similar and complimentary to the elements of the probe 100. As shown, the receiver 200 includes a receiver housing 501 for receiving the probe as well as a plurality of gripper balls 507 for gripping the probe 100. The receiver housing 501 and gripper balls 507 are positioned within an outer yoke 502. According to an embodiment, there are ten balls 507 and the balls may be made of a material such as steel or the like. FIG. 5A also shows a piston 515 for moving the gripper balls 507 into and out of gripping contact with the probe 100. Also shown is a spring closed valve arrangement having a receiver spool 520 which is inside a receiver bracket 525, with a spring 522 communicating therebetween. As outlined below, the bracket 525 is slidable with respect to the spool 520. FIG. 5A shows the receiver fuel passage 530, which extends from an aft port 531 through to openings 532 via a passageway in the spool 520. As illustrated, the valve arrangement also includes a receiver front cap 505, an elastomeric gasket 506, a slot 508 within which the gasket 506 lays, and a valve seal 510.

The spring closed valve arrangement is opened by towing tension after the probe 100 has been successfully captured. In operation, when the front body portion 401 of the probe 100 is engaged and gripped by the balls 507 within the receiver 200, as outlined above, the surface water vessel 101 backs off its throttle, and is subsequently towed by the probe 100. When the towing tension exceeds the preload in the spring 522, the assembly comprising the receiver housing 501, piston 515, gripper balls 507, and bracket 525 will move as a unit, sliding aft along the receiver spool 520. This will open an annular space between the receiver valve seal 510 and the mating surface on the bracket 525. This opens the fuel passage 530 which extends from the annular space, via the openings 532, and into the interior of the receiver spool 520. This allows fuel to be pumped through the receiver 200. The valve opening is constrained by an insert 540. The seal between the probe 100 and receiver 200 is secured by the elastomeric gasket 506 that is secured in the slot 508. As shown the slot 508 is circular and has a trapezoidal cross section. The load path for the towing force begins at the front body portion 401, and is directed to the balls 507, to the piston 515, to pressurized oil (not shown) behind the piston 515, to the housing 501, to the bracket 525 via threaded fasteners (not shown), to the insert 540, to the spool 520, and to the yoke 502.

Figure 4B:
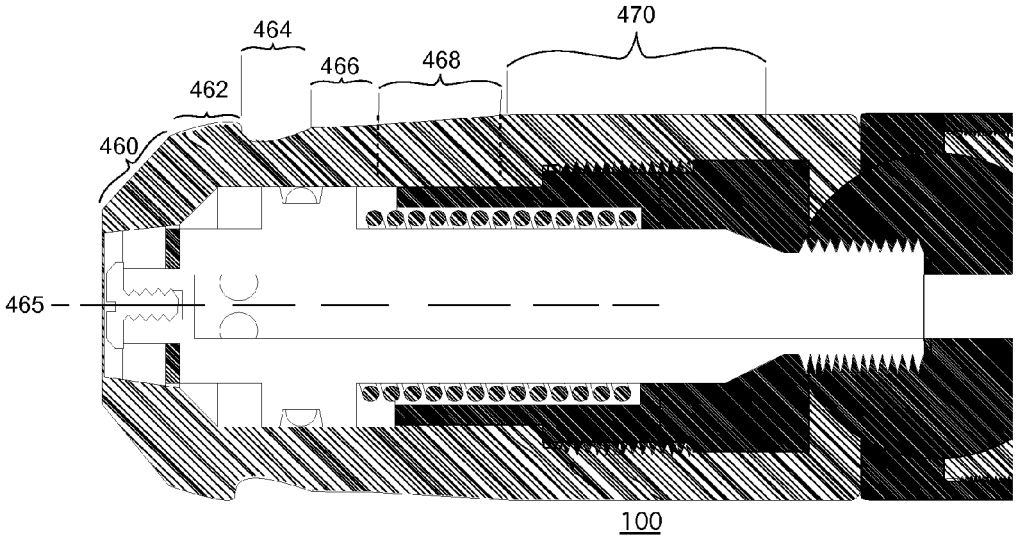
FIG. 4B is an exemplary sectional illustration of a probe showing the outer surface configuration, according to an embodiment of the invention.

FIG. 4B is an exemplary sectional illustration of a probe 100 showing the configuration of the outer surface, according to an embodiment of the invention. As outlined below, the outer surface of the probe 100 is complementary with the inner surface of the receiver 200, the complementary surfaces working together to provide a secure connection between the probe 100 and the receiver 200, and allows for the quick shut-off of connected valve arrangements. As shown in FIG. 4B, the front body portion 401 of the probe 100 is circular in cross section and its external profile has a number of features. Starting from the extreme forward end the front body portion 401 is a steep tapered conical portion 460. The front body portion 401 also includes a spherical surface portion 462, followed by a torus portion 464 forming a circular groove as shown. As shown, the front body portion 401 also includes a short prismatic portion 466, followed by a gradual tapered conical portion 468 and finally an elongated prismatic portion 470. It should be noted that FIG. 4B is a sectional illustration of the probe 100, so the different portions (460, 462, 464, 466, 468, and 470) shown at the top of the figure, extend over the entire circumference of the probe.

Figure 5B:
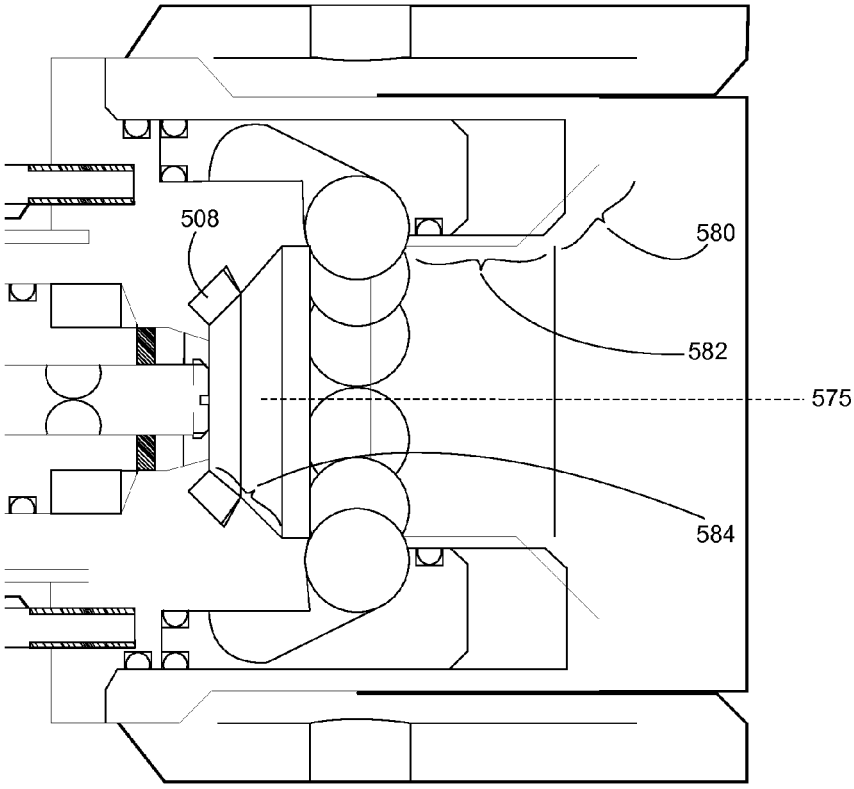
FIG. 5B is an exemplary sectional illustration of a receiver showing the internal surface configuration, according to an embodiment of the invention.

FIG. 5B is an exemplary sectional illustration of a receiver 200 showing the internal surface configuration, according to an embodiment of the invention. The interior of the receiver 200 is configured for a complementary mating relationship with the outer surface of the probe 100. As shown in FIG. 5B, the receiver interior includes a conically tapered section 580, followed by a section with constant internal diameter 582 forming the receiver opening, followed by a second conical section 584.

In operation, the probe 100 will be guided into the opening of the receiver 200. As stated above, the respective outer and inner surfaces of the probe 100 and the receiver 200 have a complimentary relationship. The steep tapered conical portion 460 of the front body portion 401 of the probe will match the conical section entrance 580 of the receiver 200, and will guide the front body portion 401 of the probe further into the receiver opening when the surface water vessel 101 is advanced. If the contact force between the front body portion 401 and the receiver conical surface 580 exceeds a predetermined preload, the front body portion 401 will articulate and enter the receiver opening 582 with its centerline 465 at a non zero angle to a centerline axis 575 of the receiver 200. To avoid jamming and/or binding, the front body portion 401 of the probe is designed with the aforementioned external spherical portion 462. This spherical form permits the front body portion 401 to assume any angular orientation within the receiver opening 582 without binding even with close tolerances.

As the front body portion 401 of the probe is further advanced into the receiver opening 582, the opening eventually makes contact with the gradual tapered conical portion 468 of the probe. The tapered portion 468 of the front body portion 401 of the probe is formed to gradually bring the receiver 200, which is mounted on a gimbal (outlined below), and front body portion 401 into close alignment without binding. Once this alignment has occurred, the centerline axis 465 of the probe will be positioned substantially co axially with the centerline axis 575 of the receiver 200. The juxtaposition of the front step tapered conical portion 460 of the probe and the forward conical surface 584 of the receiver enables a liquid tight seal between the steep tapered conical portion probe surface 460 and the elastomeric gasket 506 in the front of the receiver 200. This same juxtaposition enables the probe groove 464 to be engaged and captured by the gripper balls 507 of the receiver.

Figure 5C:
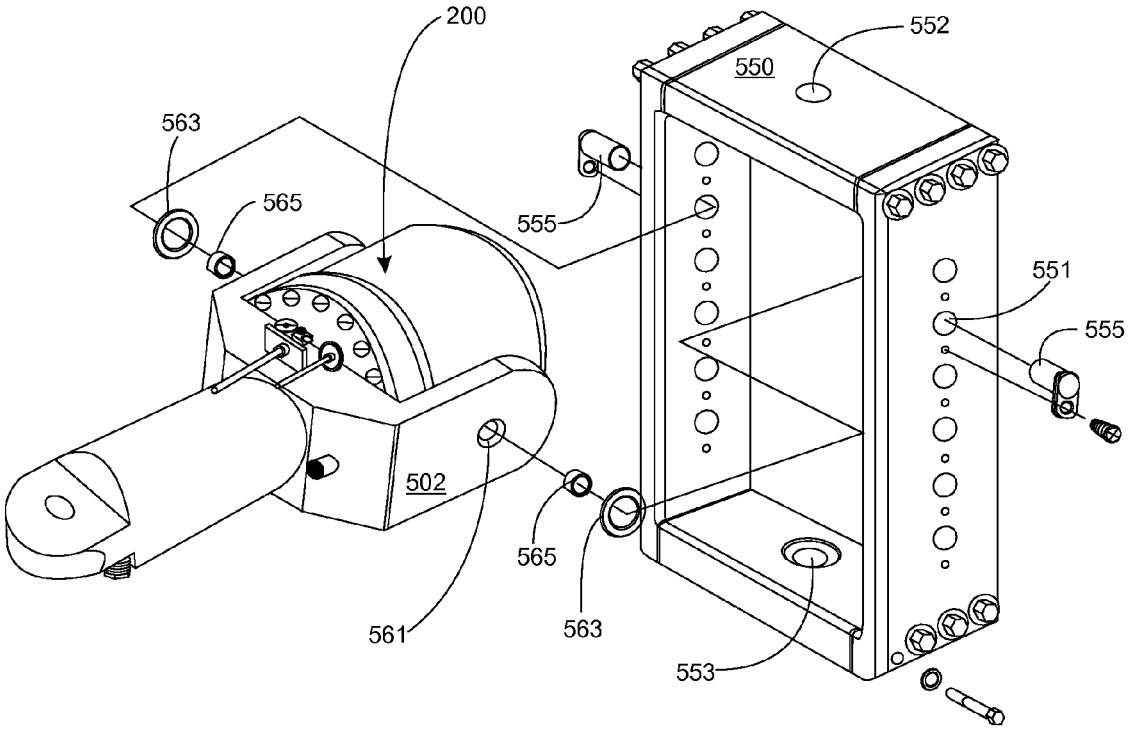
FIG. 5C is an exploded perspective illustration of a mounting arrangement for the receiver, according to an embodiment of the invention.

FIG. 5C is an exemplary exploded perspective illustration of a mounting arrangement for the receiver 200, according to an embodiment of the invention. As shown, the receiver 200 is mounted in a rectangular gimbal frame 550. The receiver 200 is attached to the gimbal frame 550 on a pivot formed by two pins 555 that fit into two of a series of holes 551 in the gimbal frame 555 and protrude into the frame interior and engage holes 561 in a yoke 502. One bushing 563 and one bearing 565 is used on each side to isolate the moving parts from one another. As such the receiver 200 is able to rotate in elevation about an axis parallel to the base plane of the floating receptacle 201 and normal to the direction of tow. For adjustability, the receiver 200 can be mounted into different holes 551 in the gimbal frame 550. The gimbal frame 550 is in turn mounted to the mounting member 220 of the floating receptacle 201 that is in turn affixed to first and second elongated arms 210 and 212 by using bolts or the like, through a hole 552 at the top and a hole 553 at the bottom. In this embodiment, the axis of the top and bottom holes 552 and 553 is coincident and forms a hinge that enables the gimbal frame 550 to rotate about an axis that is normal to the base plane of the floating receptacle 201. In addition, the hinge axes formed by holes 551, 552 and 553 intersect and are normal to one another. The combination of the foregoing features enables the receiver 200 to orient in both elevation and azimuth within the mechanical limits of the design, which is typically greater than about +/−45 degrees.

Figure 6A:
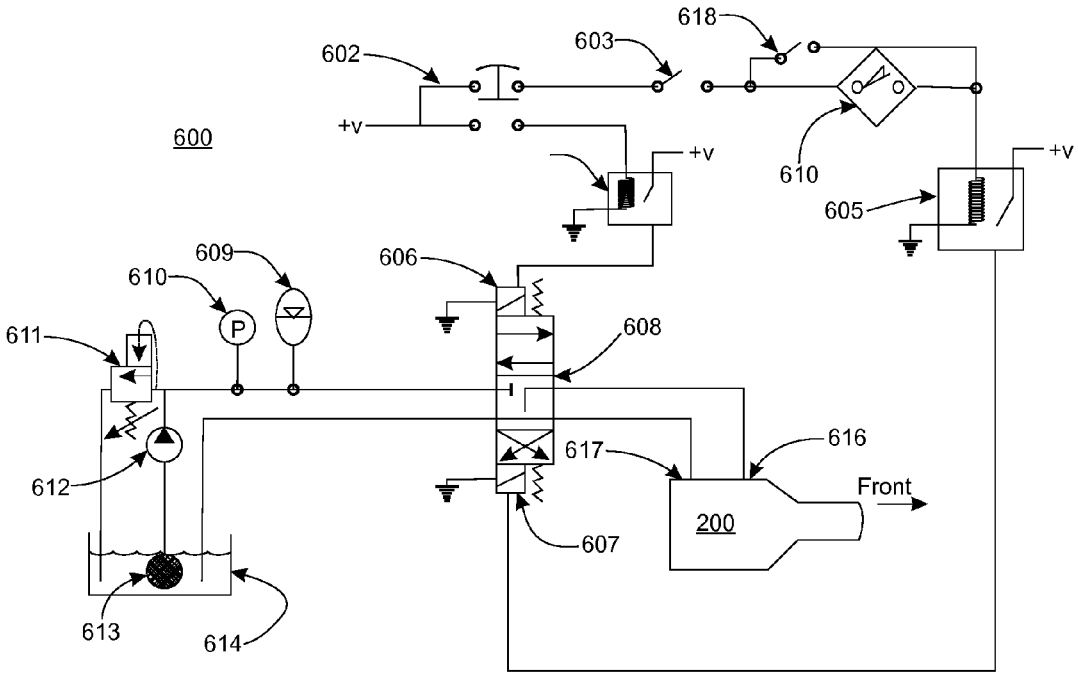
FIG. 6A is an exemplary schematic illustration of latch and release sensing system, according to an embodiment of the invention.
Figure 6B:
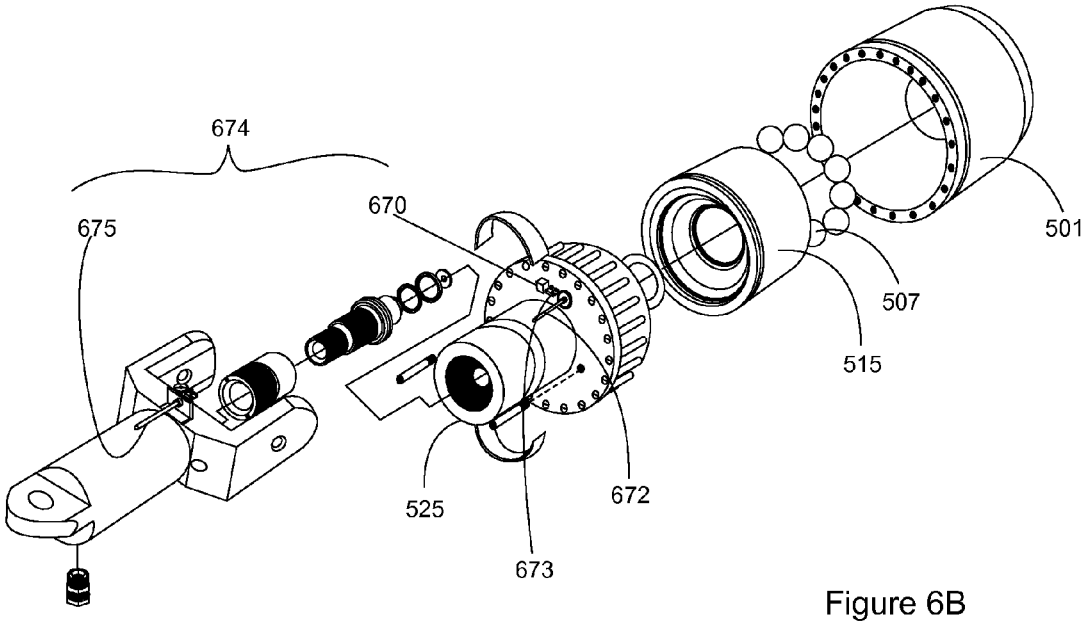
FIG. 6B is an exemplary exploded perspective illustration of the receiver, including elements of the latch and release operating system, according to an embodiment of the invention.

FIG. 6A is an exemplary schematic illustration of the latch and release operating system 600, according to an embodiment of the invention. FIG. 6B is an exemplary exploded perspective illustration of the receiver 200, including elements of the latch and release operating system 600, according to an embodiment of the invention. The latch and release operating system 600 detects when the probe 100 is properly inserted and latched in the receiver 200. As outlined above in FIG. 5A, the receiver 200 includes a piston 515 for moving the balls 507 into and out of gripping/latching contact with the probe 100. According to the embodiment of FIG. 6A, this gripping/latching arrangement mechanism may be powered hydraulically as shown in FIG. 6A.

As shown in FIG. 6A, the latch and release operating system 600 includes a reservoir 614 having hydraulic oil that is removed from the reservoir 614 via a mesh strainer 613 and conveyed via a motor driven pump 612. The system 600 also includes an accumulator 609 into which oil that is under pressure flows. The accumulator 609 stores oil under pressure until the oil is required for a latch or release event. A relief valve 611 limits the maximum value of oil pressure to a predetermined value. A pressure gauge 610 is employed to determine the correct pressure setting for the relief valve 611. The accumulator 609 is sized sufficient to supply more than one latch attempt and or a latch followed by an immediate release event. The accumulator 609 is capable of providing a ready supply of pressurized hydraulic oil at a high flow rate and is employed to rapidly complete latching once the probe 100 is in position within the receiver 200. The pump 612 is sized to replenish the accumulator within a time period that is less than that required for the surface water vessel 101 to disengage from the floating receptacle 201 following an unsuccessful latching attempt, back off, and make another approach that will permit successive latching attempts until a connection is achieved. The combination of small hydraulic pump 612 and accumulator 609 minimizes the total weight and cost of the machinery.

The system 600 includes sensors, outlined below, that do not control the flow of liquid, but control the latch timing and they also report on the state of the system. As shown in FIG. 6B, the system 600 includes an inductive proximity sensor 670 mounted in the receiver 200. The mounting positions the sensor 670 so that it will detect the presence of the probe 100 when it has entered the receiver 200 and is in position to be latched. Also included is an inductive proximity sensor 672 that detects the presence of the piston 515 in the receiver when it reaches the full forward position. When the piston is in this position the balls 507 are forced towards the center of the receiver. If the probe 100 is in position as sensed by the sensor 670 and the ball piston 515 is full forward, as sensed by sensor 672, then a mechanical latching is achieved. The system 600 also includes a micro switch sensor 674 having a magnet 673 mounted into the moving bracket 525 of the receiver 200 and a reed switch 675 mounted on a small piece of angle aluminum mounted onto the yoke 502. The reed switch 675 is normally closed, so when it is close to the magnet 673 the switch is open.

The system is designed to automatically capture the probe 100 when it reaches the appropriate position within the receiver 200. A maintained contact switch 603 supplies the latching system by connecting electrical voltage to the proximity sensor 670 in the receiver 200. The hydraulic pump 612 is driven by an electric motor not shown that is electrically energized by an operator controlled switch not shown. The probe 100 enters the aft end of the receiver assembly 200, specifically the housing 501. When the probe 100 reaches the front of the receiver 200, its presence is detected by proximity sensor 670. Proximity sensor 670 responds by sending a 24 VDC signal, which energizes a relay 605. The relay 605 connects electrical power to and energizes a solenoid 607, which shifts a connected three way valve 608, connecting hydraulic fluid under pressure to the aft side of the piston 515 via hydraulic connection 617 on the receiver 200 and the hydraulic drain to the forward side of the piston 515 via hydraulic connection 616 on the receiver 200.

According to this operation, oil flows into the space between the aft face of the piston 515 and the housing 501, moving the piston 515 forward in the receiver housing 501. The piston 515 has a conically tapered interior surface that pushes the steel balls 507 forward and then forces them into a circular slot formed by the housing 501 and the receiver bracket 525. The balls 507 engage the circular groove in the probe tip 100. When the piston 515 has traveled all the way forward in the housing 501, it will be detected by the sensor 672. The sensor 672 then sends a 24 VDC electrical signal that indicates that the receiver 200 has fully latched. The combination of sensors 670 and 672 indicates a successful latching of the probe 100 into the receiver 200.

After a latching event the surface water vessel 101 will reduce propulsive power and will be towed by the latched probe 100. When the towing tension exceeds the spring preload in the receiver 200, as outlined above with respect to FIG. 4A, the valve will open. When the receiver valve has opened, the magnet 673 mounted on the moving bracket 525 will be moved away from the reed switch 675. This interaction between the elements of the sensor 674, i.e., the magnet 673 and the reed switch 675, essentially closes the sensor 674 and sends a 24 VDC signal to the controls. The combination of sensors 670, 672, and 674 indicates that the system has latched and that the fluid passageway is open and ready to pass the fuel.

The system 600 is fitted with a manual override feature that comprises one maintained contact switch 618 that bypasses the inductive proximity sensor 670. Consequently, the operator may manually command the receiver 200 to latch with or without the presence of the probe 100. This feature can be employed to manually check the system's operability prior to an engagement and to circulate hydraulic oil within the system to, for example, ensure all components are at a similar temperature to reduce the likelihood of thermally locking close fitting components such as the receiver piston 515 within the housing 501.

Releasing the probe 100 from the receiver 200 is accomplished manually by depressing switch 602, which when depressed will simultaneously disconnect electrical power from the latch arm switch 603 and all components downstream as depicted in the figure including the inductive proximity sensor 670, relay 605, and solenoid 607, and energize relay 604 that will connect electrical power to solenoid 606 that will shift the three way valve 608 to connect hydraulic fluid under pressure to the forward side of the piston 515 via hydraulic connection 616 on the receiver 200 and the hydraulic drain to the aft side of the piston 515 via hydraulic connection 617 on the receiver 200. Oil flows into the space between the forward face of the piston 515 and the housing 501, moving the piston 515 aft in the receiver housing 501 and releasing the probe 100.

What has been described and illustrated herein are preferred embodiments of the invention along with some variations. The terms, descriptions and figures used herein are set forth by way of illustration only and are not meant as limitations. For example, elements of the invention may be exaggerated merely to illustrate the operation thereof. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A fueling system for securing and fueling a water vessel at a floating receptacle, the fueling system comprising:

a parent ship for supplying fuel;

a floating receptacle remote from the parent ship, the floating receptacle having a substantially V-shape with a substantially V-shaped aperture, and comprising;

a first arm, a second arm, and a mounting member, wherein the first and second arm are adjustably attached to the mounting member so that the mounting member, the first arm, and the second arm form the substantially V-shape and substantially V-shaped aperture, with the mounting member at the apex of the substantially V-shape, the adjustably attached first and second arms allowing for an adjustable apex angle $\alpha$, and wherein the mounting member further includes a receiver;

a fuel conduit for transporting fuel from the parent ship to the floating receptacle, a water vessel comprising a probe for positioning within the receiver of the floating receptacle to contemporaneously latch the water vessel to the receiver and to receive fuel via the fuel conduit at the floating receptacle;

a towing bridle having a plurality of tow lines, the tow bridle attached to and extending between the parent ship and the floating receptacle maintaining a towing tension on the first and second arms of the floating receptacle so that the adjustable apex angle $\alpha$ is at a maximum angle; and an inter arm line connected to each of the first and second arms for restricting the adjustable apex angle $\alpha$ at the maximum angle and for reducing the angle $\alpha$ to an angle commensurate with the shape of the water vessel, as the water vessel enters into the substantially V-shaped aperture thereby automatically guiding the water vessel towards the receiver.

2. The fueling system of claim 1, wherein the probe comprises a spring closed valve arrangement that is opened by an increased towing tension when the probe is latched to the receiver.

3. The fueling system of claim 2, wherein the probe further comprises:

a front body portion;

a back body portion;

a ball connecting the front body portion to the back body portion;

a probe fuel port extending from the front body portion to the back body portion, wherein the spring closed valve arrangement is located in the front body portion, the spring closed valve arrangement comprising:

a probe spool;

a probe compression spring around the spool communicating with the probe spool and the front body portion, wherein the front body portion is slidable with respect to the spool.

4. The fueling system of claim 3, wherein when the probe is latched to the receiver, the increased towing tension applied to the front body portion exceeds a pre load on the compression spring, which results in the front body portion sliding forward on the probe spool thereby opening up the valve.

5. The fueling system of claim 4, wherein the spring closed valve arrangement of the probe closes automatically when the towing tension is lost.

6. The fueling system of claim 5, wherein the receiver further comprises:

an outer yoke;

a receiver housing within the outer yoke;

gripper balls rotatably positioned within the outer yoke;

a piston for moving the gripper balls into and out of gripping contact with the probe;

a receiver bracket, wherein the spring closed valve arrangement is located within the receiver bracket, the spring closed valve comprising:

a receiver spool; and a spring on the outside of the receiver spool communicating with the receiver spool and the receiver bracket, wherein the receiver bracket is slidable with respect to the receiver spool.

7. The fueling system of claim 6, wherein the probe spool has a tapered portion in an aft portion providing clearance to enable about 45 degrees rotation of the ball, the tapered portion also being frangible so that if the ball is forced to bend more than 45 degrees the probe spool will fail leaving the ball in a position that substantially blocks the probe fuel port thereby minimizing fuel spillage.

8. The fueling system of claim 7, wherein starting at the tip of the probe the outer surface of the front body portion comprises:

a steep tapered conical portion;

a spherical portion;

a torus portion forming a groove;

a short prismatic portion;

a gradual tapered conical portion; and an elongated prismatic portion, wherein the steep tapered conical portion, the spherical portion, the torus portion, the short prismatic portion, the gradual tapered conical portion, and the elongated prismatic portion form a continuous outer surface of the front body portion of the probe.

9. The fueling system of claim 8, wherein the receiver has an opening with an inner surface comprising:

a first conically tapered section;

a constant diameter section; and a second conically tapered section, wherein the first conically tapered section, the constant diameter section, and the second conically tapered section of the inner surface receive therein, the steep tapered conical portion, the spherical portion, the torus portion, the short prismatic portion, the gradual tapered conical portion, and the elongated prismatic portion of the probe, wherein upon latching, the gripper balls of the receiver engage the torus portion of the probe.

10. The fueling system of claim 6, further comprising a plurality of sensors on the receiver for detecting that the probe is latched and the fuel port is open.

11. The fueling system of claim 6, wherein the water vessel further comprises a hatch assembly at the bow of the water vessel, wherein the probe is retractable and stored within the hatch assembly when not in use and extends out of the hatch assembly at the bow of the water vessel when deployed.

12. The fueling system of claim 9, wherein the hatch assembly comprises:

an upper hatch cover;

a lower hatch cover;

a frame;

an upper bracket pivotally attached to the frame, wherein the upper hatch cover is fitted to the upper bracket;

a lower bracket pivotally attached to the frame, wherein the lower hatch cover is fitted to the lower bracket; and first and second elastic members attached to the upper and lower brackets, respectively, for biasing the upper and lower hatch covers in a closed position.

13. The fueling system of claim 12, wherein the water vessel further comprises a linkage arrangement for extending the probe out of the hatch assembly when deployed and for retracting the probe within the hatch assembly when not in use, the linkage arrangement comprising:

an aft link;

a forward link;

an interface mount;

a first pivot member, wherein the aft link is connected to the interface mount via the first pivot member;

a second pivot member, wherein the aft link is connected to the forward link via the second pivot member;

a third pivot member, wherein the forward link is connected to the probe via the third pivot member;

a fourth pivot member;

a fifth pivot member; and a linear actuator having an upper end and a lower end, wherein the upper end of the linear actuator is connected to the aft link via the fourth pivot member, and the lower end of the linear actuator is connected to the interface mount via the fifth pivot member.

14. The fueling system of claim 6, wherein the floating receptacle further comprises:

a first outrigger extending from the first arm; and a second outrigger extending from the second arm, wherein in the towing bridle, the plurality of lines comprise:

an aft starboard tow line attached at one end to the first arm and at another end to first outrigger;

an aft port tow line attached at one end to the second arm and at another end to second outrigger;

a forward starboard tow line attached at one end to the aft starboard tow line;

a forward port tow line attached at one end to the aft port tow line;

a center tow line attached at one end to mounting member; and a lead tow line, attached at one end to the parent ship, and at another end to each of the other ends of the forward starboard tow line, the forward port tow line, and the center tow line.

15. The fueling system of claim 6, wherein each of the first and second arms include an angled counter at respective free ends, each angled counter comprise a flat angled surface at a bottom portion of each arm for contacting the water, each angled counter offsetting the tendency to submerge and reducing the towing drag.

* * * * *